US010593156B2

(12) United States Patent
Ruckle

(10) Patent No.: US 10,593,156 B2
(45) Date of Patent: Mar. 17, 2020

(54) SYSTEMS AND METHODS FOR GAMING DROP BOX MANAGEMENT

(71) Applicant: IGT, Las Vegas, NV (US)

(72) Inventor: Clyde Ruckle, Las Vegas, NV (US)

(73) Assignee: IGT, Las Vegas, NV (US)

( * ) Notice: Subject to any disclaimer, the term of this patent is extended or adjusted under 35 U.S.C. 154(b) by 108 days.

(21) Appl. No.: 15/709,621

(22) Filed: Sep. 20, 2017

(65) Prior Publication Data

US 2019/0088085 A1 Mar. 21, 2019

(51) Int. Cl.
*G07F 17/32* (2006.01)

(52) U.S. Cl.
CPC ..... *G07F 17/3248* (2013.01); *G07F 17/3209* (2013.01); *G07F 17/3211* (2013.01); *G07F 17/3225* (2013.01); *G07F 17/3246* (2013.01)

(58) Field of Classification Search
CPC .... G07F 9/06; G07F 17/3227; G07F 17/3248; G07D 11/0093; G07D 11/23; G07D 11/26; G07D 11/30; G07D 11/32; G07D 11/34; G07D 11/36
See application file for complete search history.

(56) References Cited

U.S. PATENT DOCUMENTS 5,818,336 A * 10/1998 Varga ..... A47G 29/1207 340/545.1
6,222,465 B1 4/2001 Kumar et al.
7,815,507 B2 10/2010 Parrott et al.
8,643,680 B2 2/2014 Baldwin et al.
9,244,527 B2 1/2016 Lathrop et al.
9,308,439 B2 4/2016 Aoki et al.
2004/0002386 A1* 1/2004 Wolfe ..... G07F 17/3218 463/42
2005/0040006 A1* 2/2005 Kodela ..... G07F 7/04 194/206
2008/0041932 A1* 2/2008 Christophersen ..... G07D 11/00 235/379
2010/0224462 A1* 9/2010 Vienneau ..... G07F 17/32 194/302
2011/0304606 A1 12/2011 Walsh
2012/0105486 A1 5/2012 Lankford et al.
2012/0322542 A1 12/2012 Chudd et al.
2013/0316797 A1* 11/2013 Gelinotte ..... G07F 17/322 463/25
2014/0323194 A1 10/2014 Keilwert
2015/0169053 A1 6/2015 Bozarth et al.
(Continued)

*Primary Examiner* — Omkar A Deodhar
*Assistant Examiner* — Ross A Williams
(74) *Attorney, Agent, or Firm* — Sage Patent Group

(57) ABSTRACT

Provided are methods for gaming drop box management. Methods include receiving, from an electronic gaming machine (EGM), drop box initiator data that corresponds to a drop box initiator ticket that is received by the EGM, automatically identifying the drop box initiator ticket as a first transaction item in a drop box session that begins responsive to a drop box being installed in the EGM and that ends corresponding to the drop box being removed from the EGM, and receiving, from the EGM, drop box session transaction data that occurs after the drop box initiator ticket is received by the EGM during the drop box session. Methods further include automatically associating the drop box with the EGM for the time period corresponding to the drop box session.

20 Claims, 8 Drawing Sheets

(56) References Cited

U.S. PATENT DOCUMENTS

| | | | |
|---|---|---|---|
| 2016/0093136 | A1 | 3/2016 | Lyons et al. |
| 2016/0252957 | A1 | 9/2016 | Raux |
| 2017/0169662 | A1 | 6/2017 | Froy et al. |

* cited by examiner

SYSTEMS AND METHODS FOR GAMING DROP BOX MANAGEMENT

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

FIELD

Embodiments described herein relate to systems, methods and computer program products for associating drop box contents with specific electronic gaming machines (EGMs).

BACKGROUND

An electronic gaming machine (EGM) that is configured to provide a wager-based game can be likened to a combination of an automatic teller machine and a home gaming console. The automatic teller machine aspect relates to the cash handling capabilities of the EGM which allow it to securely receive, store and dispense cash or an indicia of credit redeemable for cash.

To provide cash handling capabilities, a common configuration for an EGM, such as a video slot machine or mechanical slot machine, is to include a bill validator and a ticket printer. The bill validator is configured to accept and validate cash currency and ticket vouchers where the ticket vouchers are bearer instruments redeemable for cash or game play on an EGM. Accepted cash or ticket vouchers can be converted to credits that are used to make wagers on the EGM. The accepted tickets and bills are stored within a cash box, also referred to as a drop box, secured within a locked EGM cabinet. When a player wishes to leave and has credits remaining on the EGM, the credits are converted to a cash value and are output as a ticket voucher via the printer where the cash value is typically printed on the ticket. The printed ticket voucher can be used to add credits to another EGM or the printed ticket voucher can be redeemed for its cash value.

Significant labor costs result from using a bill validator and a ticket printer on an EGM. The labor costs involve periodically removing a drop box including received tickets and cash from the EGM and replacing it with an empty one, counting the cash and tickets removed from the EGM and refilling the ticket stacks on the EGM. Additionally, the drop box is typically manually marked with an identification of the EGM that it was removed from and a date and time of removal.

The removed drop box is typically transported to a secure area where additional personnel are involved in counting and recording the various sums of cash and/or ticket vouchers removed from each EGM. The cash amounts removed from each EGM are reconciled with other information sources, such as from hard meters on the EGM or records from a server that generates and validates ticket vouchers. The reconciliation process may be important for ensuring the earnings from the EGM are properly taxed.

Identifying a drop box at retrieval may be error prone and may introduce irregularities corresponding to the reconciliation. One solution to such issues includes a smart drop box that includes complex technology that validates and records transactions for each of the contents therein. However, such smart drop boxes may result in significant additional costs for the drop box relative to a "dumb" drop box that is without the validation and/or recording components. Additionally, smart drop boxes may be configured to operate in specific EGM types, such as manufacturer specific smart drop boxes. Such configurations may result in even greater expense for an operator such as a casino.

SUMMARY

A method according to some embodiments includes receiving, from an electronic gaming machine (EGM), drop box initiator data that corresponds to a drop box initiator ticket that is received by the EGM, automatically identifying the drop box initiator ticket as a first transaction item in a drop box session that begins responsive to a drop box being installed in the EGM and that ends corresponding to the drop box being removed from the EGM, receiving, from the EGM, drop box session transaction data that occurs after the drop box initiator ticket is received by the EGM during the drop box session, and automatically associating the drop box with the EGM for the time period corresponding to the drop box session.

Some embodiments include generating a drop box session report that includes the drop box session transaction data corresponding to currency and/or transaction receipts that are stored in a stacker of the drop box. In some embodiments, the transaction receipts comprise data tickets that are received to convey monetary value from a player account to the EGM. Some embodiments provide generating the drop box session report includes retrieving the drop box initiator ticket from the drop box after the drop box is removed from the EGM, and associating the drop box, the EGM and the drop box session transaction data.

In some embodiments, the drop box initiator ticket is visually distinctive from the transaction receipts. Some embodiments provide the drop box initiator ticket includes a first color and the transaction receipts include a second color that is different from the first color.

In some embodiments, automatically identifying the drop box initiator ticket as a first transaction item in the drop box session includes detecting a unique identifier on the drop box initiator ticket. Some embodiments provide that the drop box initiator ticket comprises a nominal transaction amount.

Some embodiments include providing the drop box initiator ticket that includes a unique identifier and that is configured to be received by the EGM upon installation of the drop box therein.

In some embodiments, the method further includes receiving, from the EGM, a drop signal that indicates a completion of the drop box session and, responsive to receiving the drop signal, associating the drop box session transaction data that was received after the drop box initiator ticket was received by the EGM. Some embodiments provide that the drop box includes a first drop box, the drop box initiator ticket includes a first drop box initiator ticket, the drop box initiator data includes first drop box initiator data, and the drop box session includes a first drop box session that is initiated corresponding to the first drop box initiator ticket and corresponds to the first drop box. In some embodiments, receiving the drop signal includes receiving, from the EGM, second drop initiator data that corresponds to a second drop box initiator ticket that is received by the EGM and that corresponds to a second drop box that is installed in the EGM after the first drop box is removed.

Some embodiments include a system that includes a server that includes a processing device and a memory. The memory is configured to store computer readable instructions that, when executed, cause the processing device to receive, from an electronic gaming machine (EGM), drop box initiator data that corresponds to a drop box initiator ticket that is received by the EGM, to automatically identify the drop box initiator ticket as a first transaction item in a drop box session that begins responsive to a drop box being installed in the EGM, to receive, from the EGM, drop box session transaction data that occurs after the drop box initiator ticket is received by the EGM and during the drop box session, to automatically associate the drop box with the EGM for the time period corresponding to the drop box session, and to generate a drop box session report that includes the drop box session transaction data corresponding to currency and/or transaction receipts that are stored in a stacker of the drop box.

In some embodiments, the drop box session transaction data that is received from the EGM is provided exclusive of the drop box. Some embodiments provide the instructions that cause the processing device to generate the drop box session report are further configured to cause the processor to retrieve the drop box initiator ticket from the drop box after the drop box is removed from the EGM and to associate the drop box, the EGM and the drop box session transaction data. In some embodiments, the instructions that cause the processing device to automatically identify the drop box initiator ticket as a first transaction item in the drop box session are further configured to cause the processor to detect a unique identifier on the drop box initiator ticket. Some embodiments provide that the drop box initiator ticket includes a nominal transaction amount.

Some embodiments provide instructions that cause the processing device to receive, from the EGM, a drop signal that indicates a completion of the drop session and, responsive to receiving the drop signal, to associate the drop box session transaction data that was received after the drop box initiator ticket was received by the EGM.

Some embodiments of the present inventive concept are directed to methods that include receiving, by an electronic gaming machine (EGM), a drop box that is configured to store currency and/or transaction receipts that are received by the EGM during a drop box session and that includes a stacker that is operable to store received currency and/or transaction receipts, receiving, by the EGM, a drop box initiator ticket that includes a unique identifier that signals a beginning of the drop box session, and transmitting, by the EGM to a server, drop box initiator data that corresponds to the drop box initiator ticket that was received by the EGM.

In some embodiments, the method includes transmitting, by the EGM, a drop signal that indicates a completion of the drop box session. Some embodiments provide that the drop box includes a first drop box, the drop box session includes a first drop box session, and that transmitting the drop signal is performed corresponding to the removal of the first drop box and indicates an end of the first drop box session. Some embodiments further include receiving, by the electronic gaming machine (EGM), a second drop box that is configured to store currency and/or transaction receipts that are received by the EGM during a second drop box session that is after the first drop box session, receiving, by the EGM, a second drop box initiator ticket that includes another unique identifier that signals a beginning of the second drop box session, and transmitting, by the EGM to a server, second drop box initiator data that corresponds to the second drop box initiator ticket that was received by the EGM.

DETAILED DESCRIPTION

Embodiments of the inventive concepts provide systems and methods for managing electronic gaming machine (EGM) drop boxes that do not include validation, data logging and/or data storage hardware.

Figure 1:
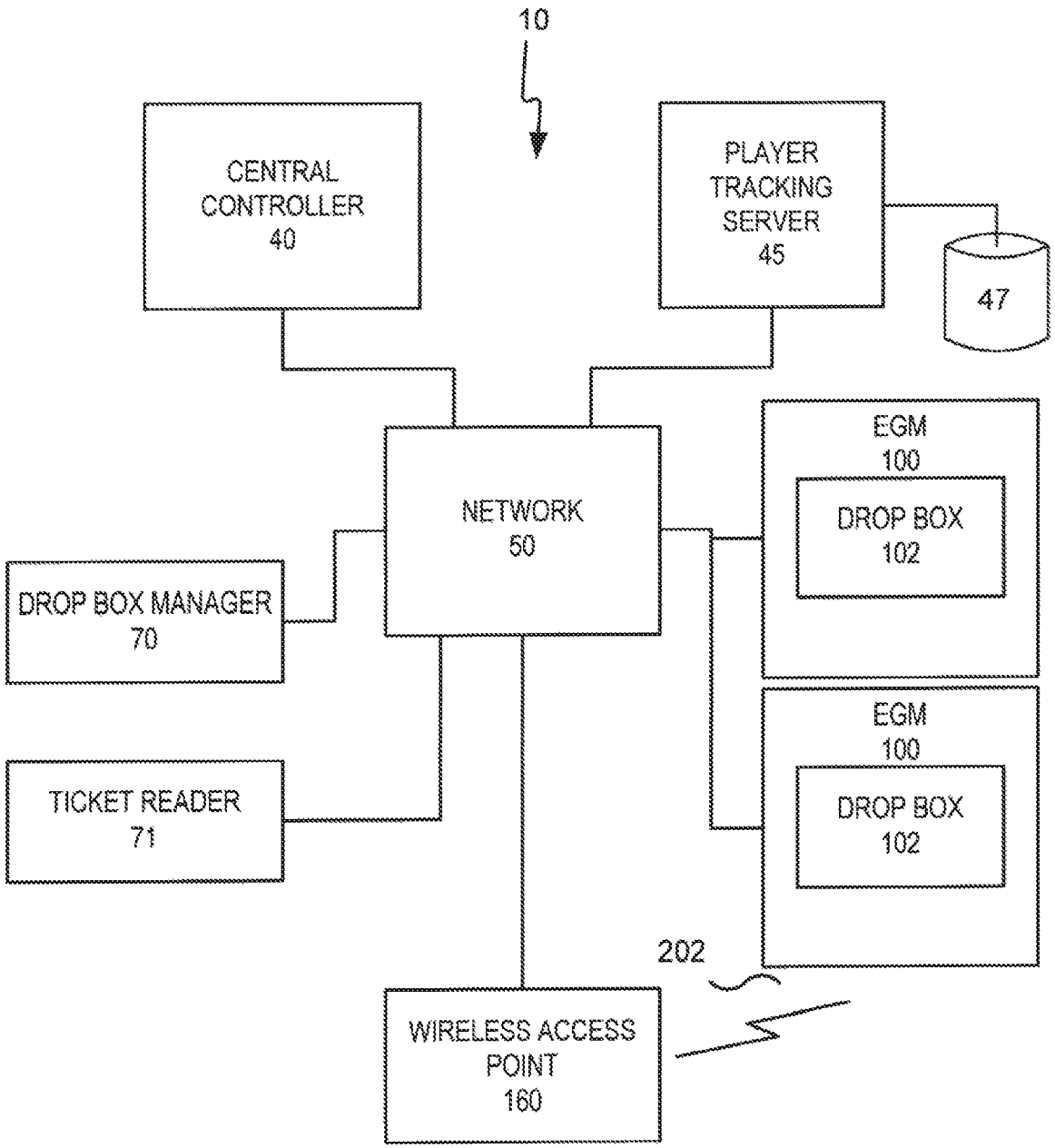
FIG. 1 is a schematic block diagram illustrating a network configuration for a gaming devices according to some embodiments.

Referring to FIG. 1, a gaming system 10 including a plurality of EGMs 100 is illustrated. The gaming system 10 may be located, for example, on the premises of a gaming establishment, such as a casino. The EGMs 100, which are typically situated on a casino floor, may be in communication with each other and/or at least one central controller 40 through a data network or remote communication link 50. The data communication network 50 may be a private data communication network that is operated, for example, by the gaming facility that operates the EGM 100. Communications over the data communication network 50 may be encrypted for security. The central controller 40 may be any suitable server or computing device which includes at least one processor and at least one memory or storage device. Each EGM 100 may include a processor that transmits and receives events, messages, commands or any other suitable data or signal between the EGM 100 and the central controller 40. The EGM processor is operable to execute such communicated events, messages or commands in conjunction with the operation of the EGM. Moreover, the processor of the central controller 40 is configured to transmit and receive events, messages, commands or any other suitable data or signal between the central controller 40 and each of the individual EGMs 100. In some embodiments, one or more of the functions of the central controller 40 may be performed by one or more EGM processors. Moreover, in some embodiments, one or more of the functions of one or more EGM processors as disclosed herein may be performed by the central controller 40.

A wireless access point 160 provides wireless access to the data communication network 50. The wireless access point 160 may be connected to the data communication network 50 as illustrated in FIG. 1, or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

In some embodiments, the gaming system 10 includes a drop box manager 70. The drop box manager 70 may be a computing system that communicates through the data communication network 50 with the EGMs 100 to manage drop boxes 102 that are installed in each of the EGMs 100 to receive and store currency and/or transaction receipts that are received by the EGM 100 during a given drop box session. The drop box manager 70 may be implemented within or separately from the central controller 40.

In some embodiments, the drop box manager 70 may associate a drop box 102 with a particular EGM 100 for a given drop box session. For example, when a new drop box is installed into an EGM 100, a drop box initiator ticket may be provided to the EGM 100 via, for example, a bill/ticket acceptor that is configured to read a drop box session identifier thereon. Data read from the drop box initiator ticket may be received by the drop box manager 70 via the network 50.

In response to the drop box initiator ticket data received by the drop box manager 70, a drop box session may be initiated and the drop box 102 may be associated with the EGM 100 for that drop box session. During the drop box session, the EGM 100 may provide data to the drop box manager 70 corresponding to each occurrence in which currency and/or a transaction receipt is received. The data received by the drop box manager 70 may be associated with the drop box session that corresponds to the drop box initiator ticket.

At the end of the drop box session, which may end corresponding to the removal of the drop box 102 from the EGM 100, a drop signal may be received by the drop box manager 70 from the EGM 100. Some embodiments provide that drop signal is generated by actuation of a drop switch or other input at the EGM 100 when the drop box 102 is being removed. In some embodiments, the drop signal is generated automatically when a new drop session is initiated after removal of the drop box 102 from the EGM 100. For example, when new drop box initiator ticket data is received by the drop box manager 70, the previous drop session may be terminated automatically.

After the drop box 102 is removed from the EGM 100, it may be transported to a count room where the contents thereof may be counted and/or reconciled. In the count room, the drop box initiator ticket may be removed from the drop box 102 and read using a ticket reader 71. The drop box manager 70 may receive the drop box initiator ticket data based on reading the drop box initiator ticket and may automatically generate a report of the contents of the drop box 102. For example, an ordered list of each currency item and/or transaction receipt may be provided. In some embodiments, summary information may be provided including the total value of currency and/or transaction receipts, the values corresponding to each of currency and transaction receipts, and values corresponding to each currency denomination.

In some embodiments, the drop box manager 70 may communicate directly with an EGM 100 over a wireless interface 202, which may be a WiFi link, a Bluetooth link, an NFC link, etc. In other embodiments, the drop box manager 200 may communicate with the data communication network 50 (and devices connected thereto, including EGMs) over a wireless interface 202 with the wireless access point 160.

By using the drop box manager 70 and the drop box initiator ticket, the EGM 100 and the drop box 102 may be automatically associated with one another for a given drop box session without requiring costly hardware added to the drop box 102. In some embodiments, operations corresponding to the drop box manager 70 and/or the central controller 40 may be performed by a server that includes a processing device and a memory. The memory may be configured to store computer readable instructions that, when executed, cause the processing device to receive drop box initiator data from an EGM 100. The drop box data may correspond to a drop box initiator ticket that is received by the EGM 100. The drop box initiator ticket may be automatically identified as a first transaction item in a drop box session that begins responsive to a drop box 102 being installed in the EGM 100. Drop box session transaction data may be received from the EGM 100. The drop box session transaction data may be received after the drop box initiator ticket is received by the EGM 100 and during the drop box session. The drop box 102 may be automatically associated with the EGM 100 for the time period corresponding to the drop box session. A drop box session report may be generated that includes the drop box session transaction data corresponding to currency and/or transaction receipts that are stored in a stacker of the drop box 102. Some embodiments provide that the drop box session transaction data that is received from the EGM is provided exclusive of the drop box. For example, the drop box may be a dumb drop box that does not include any validation technology corresponding to the currency, the transaction receipts and/or the drop box initiator ticket.

Figure 2:
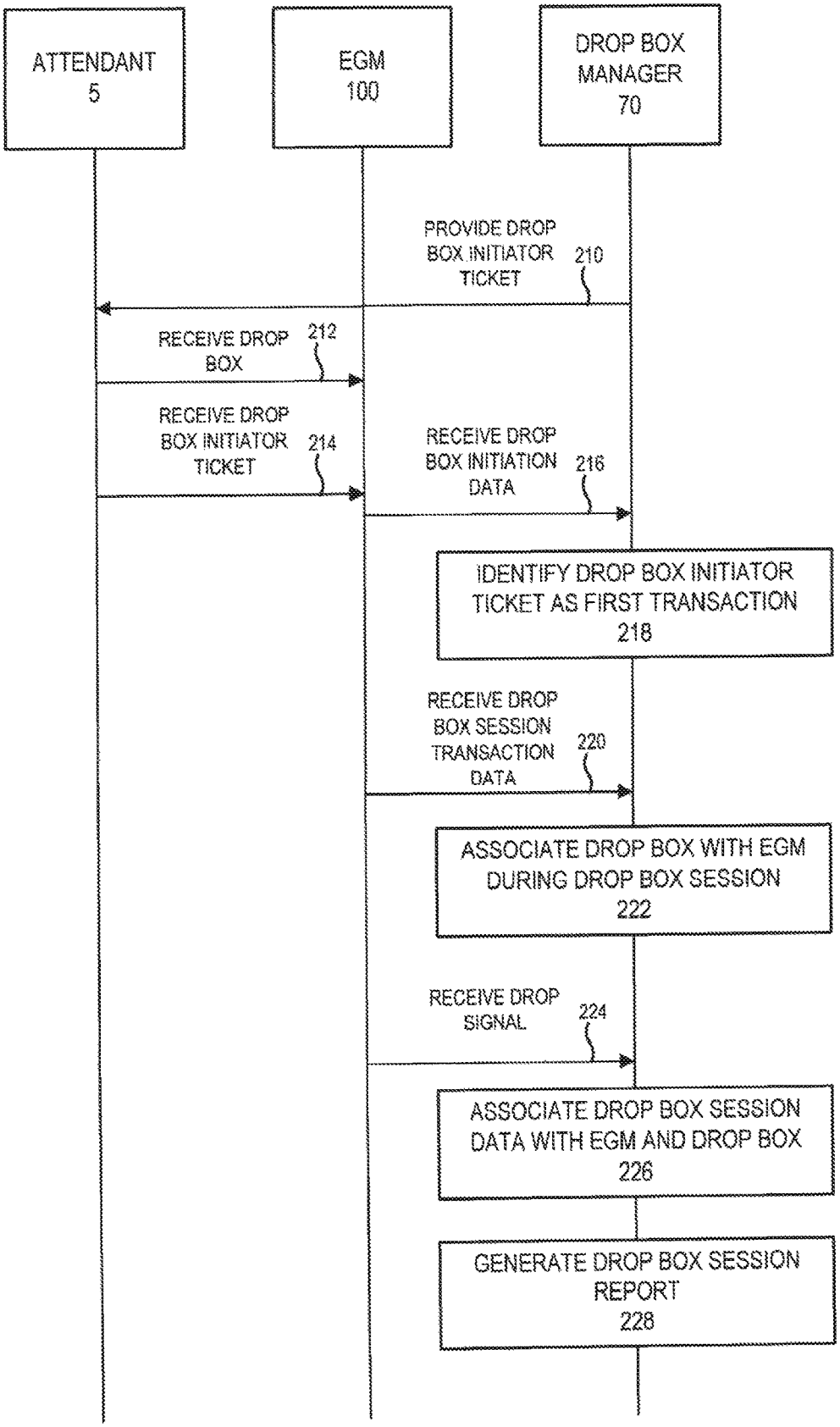
FIG. 2 is a flow diagram illustrating data flows according to some embodiments.

Reference is now made to FIG. 2, which is a flow diagram illustrating data flows according to some embodiments. Drop box initiator tickets may be provided to an attendant 5, such as a casino or other operator employee and/or representative (operation 210). The drop box initiator tickets may include an identifier that signals the EGM 100 and/or the drop box manager 70 that the drop box 102 is installed in the EGM 100 and that a new drop box session is commencing. Some embodiments provide that the drop box initiator ticket is visually distinct from other tickets that are received into the drop box 102. Some embodiments provide the drop box manager 70 causes the drop box initiator tickets to be printed. However, such embodiments are non-limiting as the drop box initiator tickets may be generated by other systems and/or be obtained from a third party provider.

When the attendant 5 goes to install a drop box 102 into an EGM 100, the attendant 5 also has a drop box initiator ticket corresponding to the drop box 102 to be installed. The EGM 100 receives the drop box 102 (operation 212) and then the EGM receives the drop box initiator ticket (operation 214).

Responsive to the EGM 100 receiving the drop box initiator ticket, the EGM 100 may transmit the drop box initiator data to the drop box manager 70. Stated differently, the drop box manager 70 may receive the drop box initiator data from the EGM 100 (operation 216). The drop box manager 70 may identify the drop box initiator ticket as a first transaction in a drop box session (operation 218). During the drop box session, the EGM 100 may send drop box session transaction data to the drop box manager 70. Stated differently, the drop box manager 70 may receive the drop box transaction data (operation 220). As used herein, drop box transaction data may include data corresponding to each item of currency and each transaction receipt stored in the drop box during a drop box session. For example, transaction receipts may include tickets that are received by the EGM 100 and that represent monetary value and/or credits that are to be transferred to the EGM 100.

During the drop box session, the drop box 102 may be associated with the EGM 100 (operation 222). In some embodiments, as the drop box transaction data is received from the EGM 100, the drop box transaction data may be associated with the EGM 100 and/or the drop box 102.

The drop box manager 70 may receive a drop signal from the EGM 100 (operation 224). Some embodiments provide the drop signal is generated at the EGM 100 responsive to the attendant 5 actuating a drop switch in the EGM 100. In some embodiments, the drop signal is generated at the EGM 100 responsive to a code that is entered by the attendant via a user interface of the EGM 100. Some embodiments provide the drop signal is generated in the EGM 100 when another drop box initiator ticket is received by the EGM 100.

Responsive to receiving the drop signal, the drop box manager 70 may terminate the current drop box session. The drop box transaction data that was received during the drop box session may be associated with the EGM 100 and with the drop box 102 (operation 226). A drop box session report may be generated (operation 228). In some embodiments, the drop box session report may include the drop box session transaction data corresponding to currency and/or transaction receipts that are stored in the stacker of the drop box 102 during the drop box session.

Figure 3:
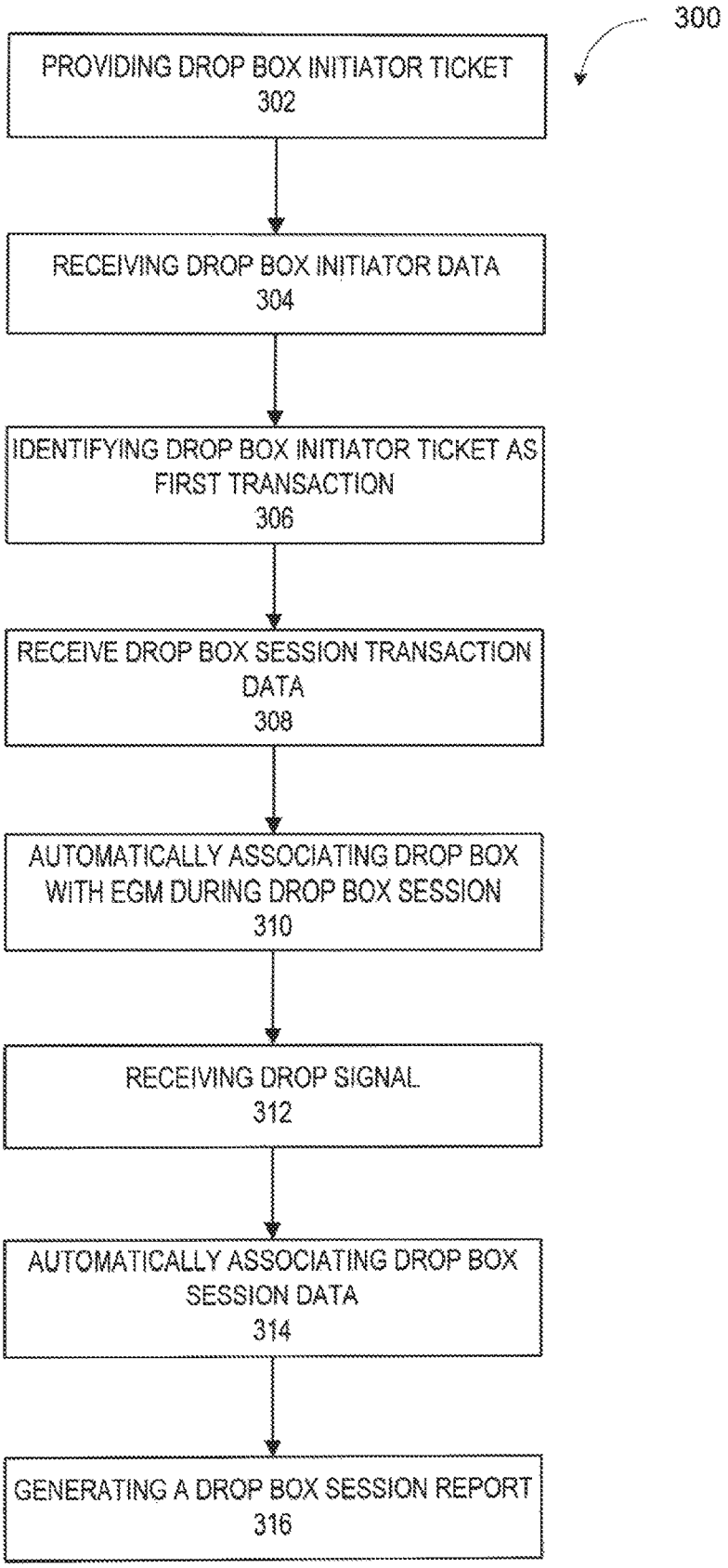
FIGS. 3-4 are flowcharts illustrating operations of systems/methods according to some embodiments.
Figure 4:
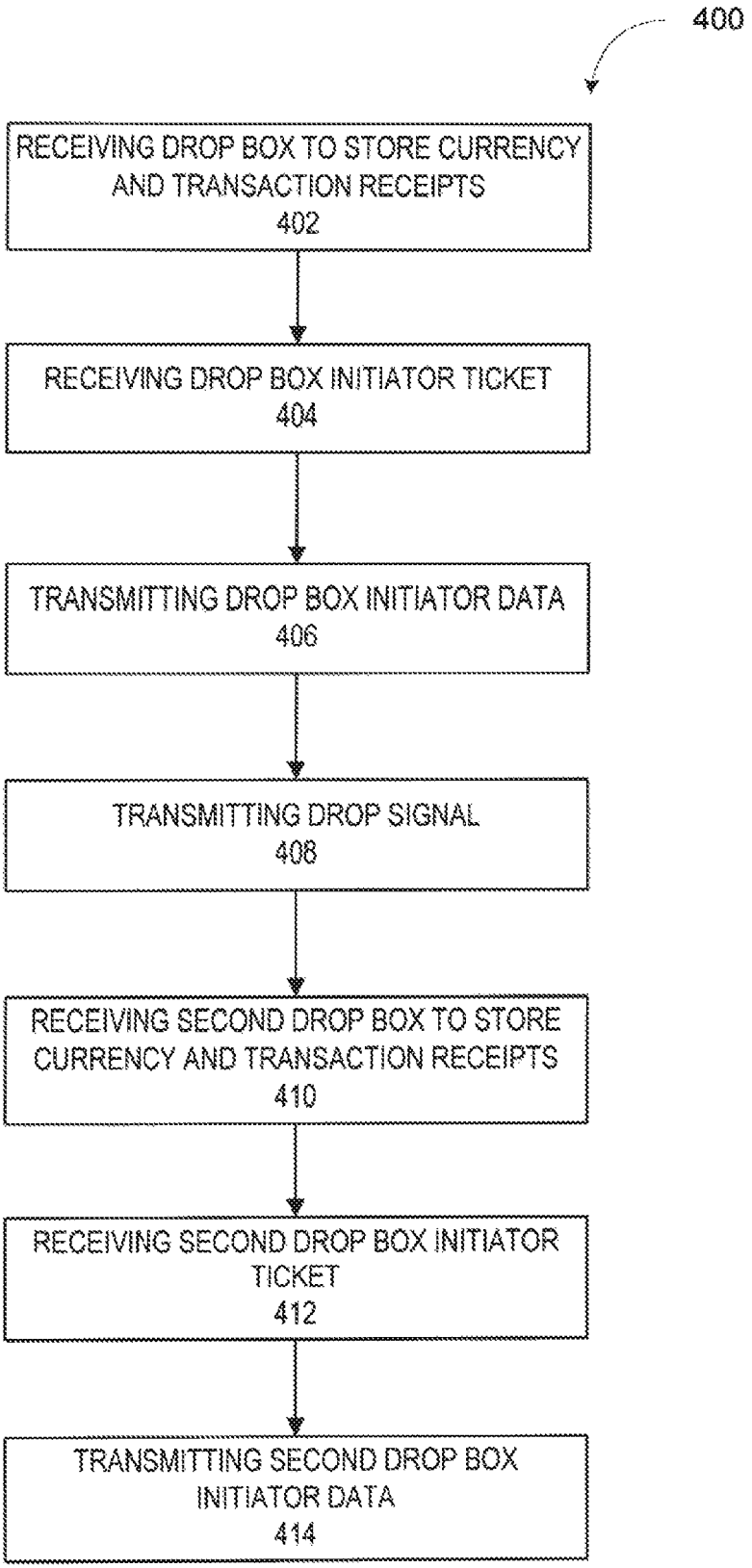

FIGS. 3-4 are flowcharts illustrating operations of systems/methods according to some embodiments. Referring to FIG. 3, some embodiments provide methods for managing drop boxes 300 include providing drop box initiator tickets that each may include a unique identifier (block 302). The unique identifier, when evaluated by a drop box manager 70, signals to the drop box manager 70 that a drop box session is being initiated for that particular drop box 102 that is installed in that particular EGM 100. Some embodiments provide that a batch of drop box initiator tickets is generated and/or printed at the direction of the drop box manager 70. In some embodiments, the drop box initiator tickets may be printed on paper that has a different color relative to other tickets that may be received into the drop box. For example, tickets used to deposit value into the EGM 100 may generally be printed on white paper while drop box initiator tickets may be printed on paper have a non-white color, such as, for example, pink, blue, green and/or yellow.

An operator, such as a casino employee, may be tasked with changing drop boxes 102 in EGMs 100. Once a new drop box 102 is installed in an EGM 100, the operator may insert a drop box initiator ticket into a ticket reader of the EGM 100. The EGM 100 is operable to read the drop box initiator ticket. Data corresponding to the drop box initiator ticket is received from the EGM 100 by the drop box manager 70 (block 304).

In response to receiving the drop box initiator data, the drop box initiator ticket is automatically identified as the first transaction item in the drop box session that begins responsive to the drop box 102 being installed in the EGM 100 (block 306). Some embodiments provide that the drop box session may end when the drop box 102 is removed from the EGM 100 and/or responsive to receiving a signal indicating that the drop box session is terminated. In some embodiments, the drop box initiator ticket includes a unique identifier the may be detected by the drop box manager 70 to identify the drop box initiator ticket as the first transaction item in the drop box session. Some embodiments provide that the drop box initiator ticket includes a nominal transaction amount. For example, a nominal transaction amount may be one cent or other trivial amounts. In some embodiments, the nominal transaction amount may be zero.

Once the drop box initiator ticket is identified as first transaction item, the drop box manager 70 receives drop box session transaction data from the EGM 100 (block 308). Drop box session transaction data may include information corresponding to each item of currency and/or transaction receipts the received into the EGM 100 and stored in the drop box 102. Transaction receipts may include tickets that are received by the EGM 100 and that correspond to a monetary value and/or credits deposited into the EGM 100. For example, transaction receipts may include data tickets that are received to convey monetary value from a player account to the EGM 100. The drop box session transaction data may be received until the drop session ends.

The drop box 102 is automatically associated with the EGM 100 for the time period corresponding to the drop box session (block 310). By automatically associating the drop box 102 with the EGM 100, the possibility of errors corresponding to accounting and reconciling the drop box 102 may be significantly reduced.

When the drop box 102 is ready to be replaced with a new drop box, the drop box manager 70 may receive a drop signal from the EGM 100 (block 312). Getting the drop signal indicates to the drop box manager 70 the completion of the drop box session. In response to receiving the drop box signal, the drop box manager 70 may associate all of the drop box session transaction data that was received after the drop box initiator ticket was received by the EGM 100 (block 314). In some embodiments, the drop box signal is generated responsive to an input signal provided at the EGM 100 when the drop box is being removed from the EGM 100. Some embodiments provide that the drop signal is generated automatically when the next drop box session is initiated based on receiving the next drop box initiator ticket.

Some embodiments provide that after the drop box session is terminated, that a drop box session report is generated (block 316). For example in some embodiments the drop box manager 70 may generate a report including all of the drop box session transaction data corresponding to tickets and/or currency stored in a stacker of the drop box as well as summary data corresponding to the values of different ones of the tickets, currency and/or currency denominations. Embodiments provide that generating the drop box session report includes retrieving the drop box initiator ticket from the drop box 102 after the drop box is removed from the EGM 100 and associating the drop box 102, the EGM 100 and the drop box session transaction data.

Referring to FIG. 4, some embodiments provide that methods for managing drop boxes 400 include receiving, by an electronic gaming machine (EGM), a drop box 102 that is configured to store currency and/or transaction receipts that are received by the EGM 100 during a drop box session (block 402). In some embodiments, the drop box 102 includes a stacker that is operable to store received currency, tickets for transferring monetary value and/or other transaction receipts.

A drop box initiator ticket is received by the EGM 100 (block 404). Some embodiments provide the drop box initiator ticket is received via a ticket reader on the EGM 100 and stored within the stacker in the drop box 102. The drop box initiator ticket may include a unique identifier that may signal the beginning of a drop box session. In some embodiments, the drop box initiator ticket is visually distinctive from other tickets that may be received by the EGM 100. For example, the drop box initiator ticket may be printed on a different color paper and/or printed to include prominent symbols that identify the ticket as a drop box initiator ticket.

Operations may include transmitting drop box initiator data by the EGM 100 to a server that may include the drop box manager 70 (block 406). The drop box initiator data may correspond to the drop box initiator ticket that was received by the EGM 100.

A drop signal may be transmitted from the EGM 100 to the server that includes the drop box manager 70 (block 408). The drop signal may indicate that the drop box session is completed. Some embodiments provide that a drop box session is completed when an operator causes a signal to be sent by actuating a drop switch in the EGM 100 when removing the drop box 102 and providing another (second) drop box. As such, operations may include receiving a second drop box to store currency and transaction receipts (block 410). Once the second drop box is installed, the EGM 100 may receive a second drop box initiator ticket (block 412). Second drop box initiator data may be transmitted by the EGM that causes a new drop box session to begin (block 414). In some embodiments, the previous drop box session is completed when the second drop box is installed and the second drop box initiator ticket is received.

Figure 5A:
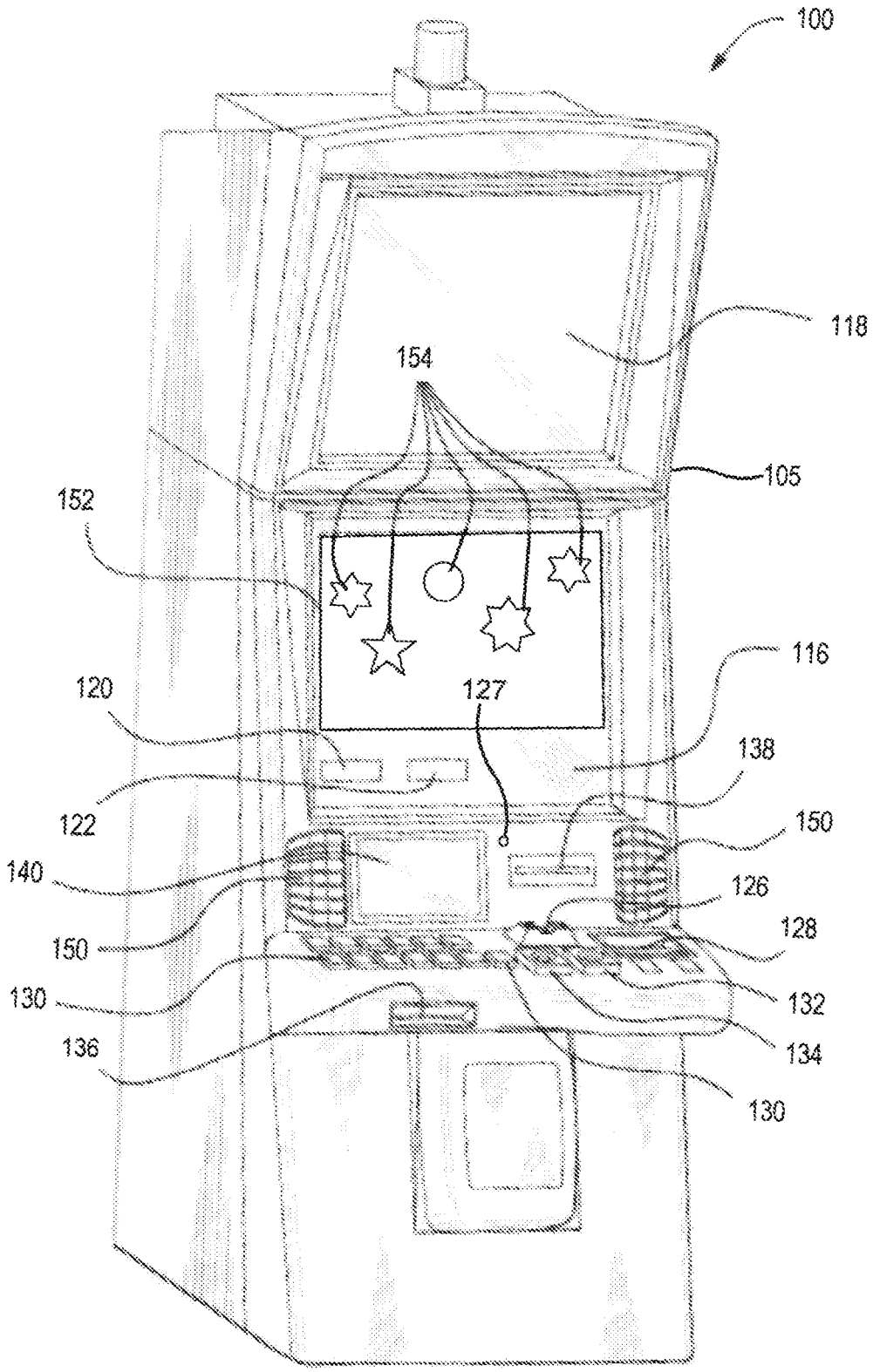
FIG. 5A is a perspective view of an electronic gaming device that can be configured according to some embodiments.
Figure 5B:
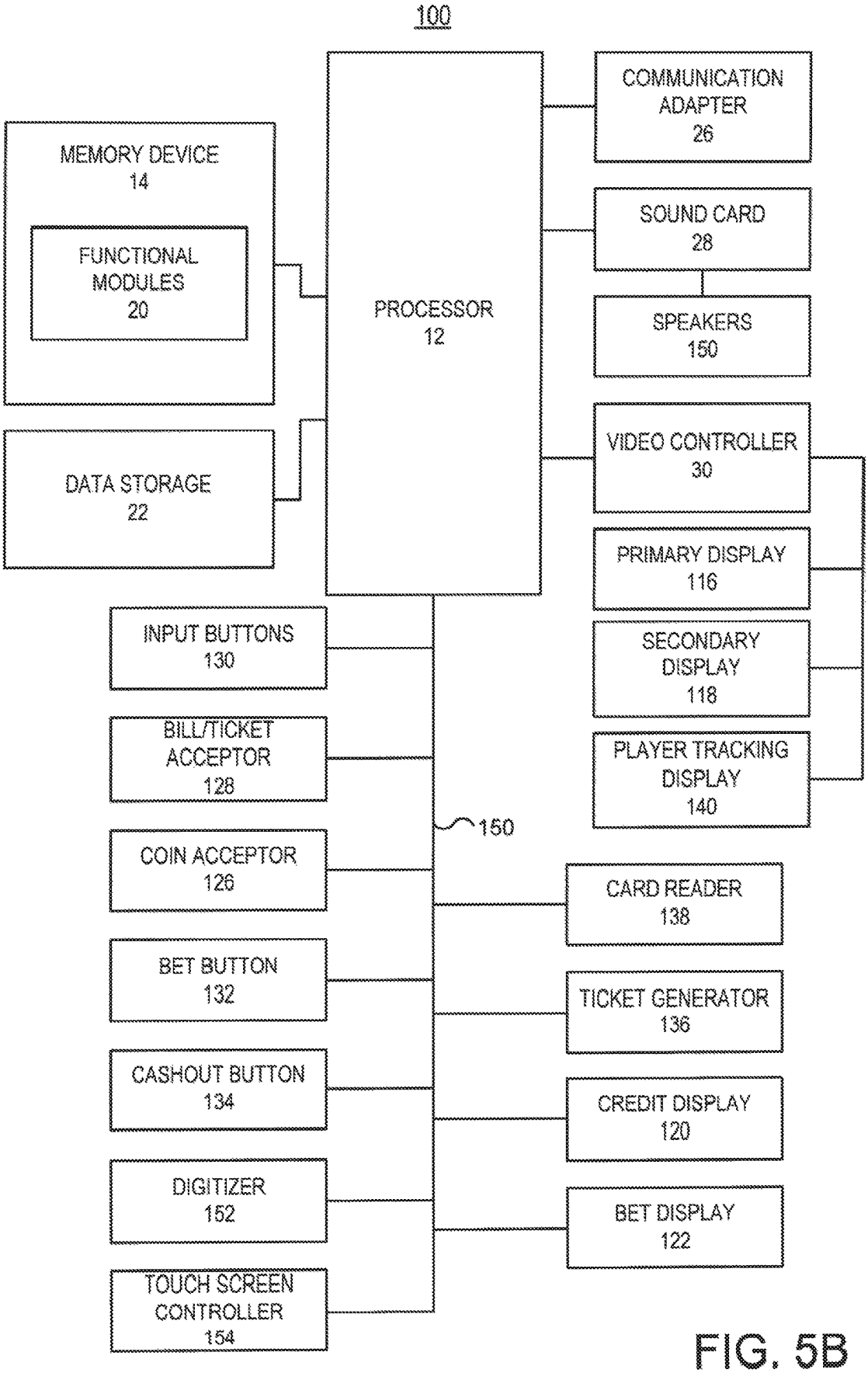
FIG. 5B is a schematic block diagram illustrating an electronic configuration for a gaming device according to some embodiments.

An example of an electronic gaming machine (EGM) that can use drop box management described herein according to various embodiments is illustrated in FIGS. 5A and 5B in which FIG. 5A is a perspective view of an EGM 100 illustrating various physical features of the device and FIG. 5B is a functional block diagram that schematically illustrates an electronic relationship of various elements of the EGM 100. The embodiments shown in FIG. 5A and to 5B are provided as examples for illustrative purposes only. It will be appreciated that EGMs may come in many different shapes, sizes, layouts, form factors, and configurations, and with varying numbers and types of input and output devices, and that embodiments of the inventive concepts are not limited to the particular EGM structures described herein.

EGMs typically include a number of standard features, many of which are illustrated in FIGS. 5A and 5B. For example, referring to FIG. 5A, an EGM 100 may include a support structure, housing or cabinet 105 which provides support for a plurality of displays, inputs, outputs, controls and other features that enable a player to interact with the EGM 100.

The EGM 100 illustrated in FIG. 1A includes a number of display devices, including a primary display device 116 located in a central portion of the cabinet 105 and a secondary display device 118 located in an upper portion of the cabinet 105. It will be appreciated that one or more of the display devices 116, 118 may be omitted, or that the display devices 116, 118 may be combined into a single display device. The EGM 100 may further include a player tracking display 140, a credit display 120, and a bet display 122. The credit display 120 displays a player's current number of credits, cash, account balance or the equivalent. The bet display 122 displays a player's amount wagered.

The player tracking display 140 may be used to display a service window that allows the player to interact with, for example, their player loyalty account to obtain features, bonuses, comps, etc. In other embodiments, additional display screens may be provided beyond those illustrated in FIG. 5A.

The EGM 100 may further include a number of input devices that allow a player to provide various inputs to the EGM 100, either before, during or after a game has been played. For example, the EGM 100 may include a plurality of input buttons 130 that allow the player to select options before, during or after game play. The EGM 100 may further include a game play initiation button 132 and a cashout button 134. The cashout button 134 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 5A and 10B includes a game play activation device in the form of a game play initiation button 132. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may have a touch-sensitive display that includes a digitizer 152 and a touchscreen controller 154 (FIG. 5B). The player may interact with the EGM 100 by touching virtual buttons on one or more of the display devices 116, 118, 140. Accordingly, any of the above described input devices, such as the input buttons 130, the game play initiation button, which may also be referred to as a "Bet Button", 132 and/or the cashout button 134 may be provided as virtual buttons on one or more of the display devices 116, 118, 140.

Referring briefly to FIG. 5B, operation of the primary display device 116, the secondary display device 118 and the player tracking display 140 may be controlled by a video controller 30 that receives video data from a processor 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processor 12. In some embodiments however, the credit display 120 and/or the bet display 122 may be driven by the video controller 30.

Referring again to FIG. 5A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touch-screen with an associated touch-screen controller 154 and digitizer 152. The display devices 116, 118, 140 may be of any suitable size, shape, and/or configuration. The display devices 116, 118, 140 may include flat or curved display surfaces.

The display devices 116, 118, 140 and video controller 30 of the EGM 100 are generally configured to display one or more game and/or non-game images, symbols, and indicia. In certain embodiments, the display devices 116, 118, 140 of the EGM 100 are configured to display any suitable visual representation or exhibition of the movement of objects; dynamic lighting; video images; images of people, characters, places, things, and faces of cards; and the like. In certain embodiments, the display devices 116, 118, 140 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include multiple different physical devices that are operable to receive monetary value from the player. In some embodiments, such devices include a ticket dispenser 136, a bill/ticket acceptor 128, and a coin acceptor 126 that allows the player to deposit coins into the EGM 100.

While not illustrated in FIG. 5A, the EGM 100 may also include a note dispenser configured to dispense paper currency and/or a coin generator configured to dispense coins or tokens in a coin payout tray.

The EGM 100 may further include one or more speakers 150 controlled by one or more sound cards 28 (FIG. 5B). The EGM 100 illustrated in FIG. 5A includes a pair of speakers 150. In other embodiments, additional speakers, such as surround sound speakers, may be provided within or on the cabinet 105. Moreover, the EGM 100 may include built-in seating with integrated headrest speakers.

In various embodiments, the EGM 100 may generate dynamic sounds coupled with attractive multimedia images displayed on one or more of the display devices 116, 118, 140 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 5B is a block diagram that illustrates logical and functional relationships between various components of an EGM 100. As shown in FIG. 5B, the EGM 100 may include a processor 12 that controls operations of the EGM 100. Although illustrated as a single processor, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor 12 may be variously referred to as a "controller," "microcontroller," "microprocessor" or simply a "computer." The processor may further include one or more application-specific integrated circuits (ASICs).

Various components of the EGM 100 are illustrated in FIG. 5B as being connected to the processor 12. It will be appreciated that the components may be connected to the processor 12 through a system bus, a communication bus and controller, such as a USB controller and USB bus, a network interface, or any other suitable type of connection.

The EGM 100 further includes a memory device 14 that stores one or more functional modules. The memory device 14 may store program code and instructions, executable by the processor 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processor through a universal serial bus (USB) hub (not shown) connected to the processor 12. U.S. Patent Application Publication No. 2004/0254014 describes a variety of EGMs including one or more communication ports that enable the EGMs to communicate and operate with one or more external peripherals.

In some embodiments, the EGM 100 may include a sensor, such as a camera in communication with the processor 12 (and possibly controlled by the processor 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processor 12 may incorporate that image into the primary and/or secondary game as a game image, symbol or indicia.

Figure 5C:
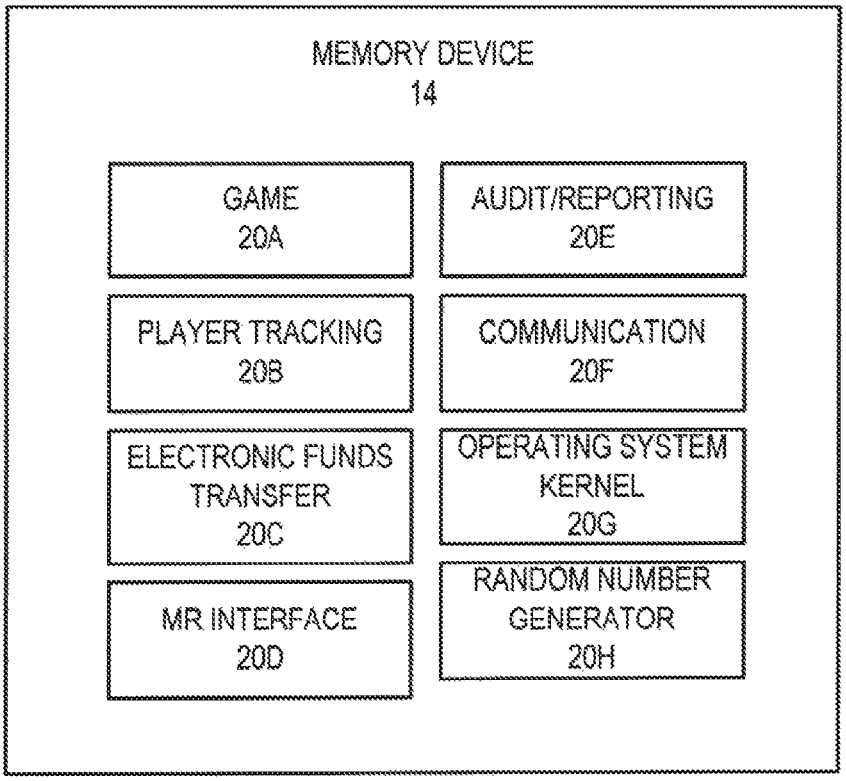
FIG. 5C is a schematic block diagram illustrating a memory device of FIGS. 5A and 5B.

Various functional modules of that may be stored in a memory device 14 of an EGM 100 are illustrated in FIG. 5C. Referring to FIG. 5C, the EGM 100 may include in the memory device 14 a game module 20A that includes program instructions and/or data for operating a hybrid wagering game as described herein. The EGM 100 may further include a player tracking module 20B, an electronic funds transfer module 20C, a wide area progressive module 20D, an audit/reporting module 20E, a communication module 20F, an operating system 20G and a random number generator 20H. The player tracking module 20B keeps track of the play of a player. The electronic funds transfer module 20C communicates with a back end server or financial institution to transfer funds to and from an account associated with the player. The wide area progressive (WAP) interface module 20D interacts with a remote WAP server to enable the EGM 100 to participate in a wide area progressive jackpot game as described in more detail below. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

Figure 6:
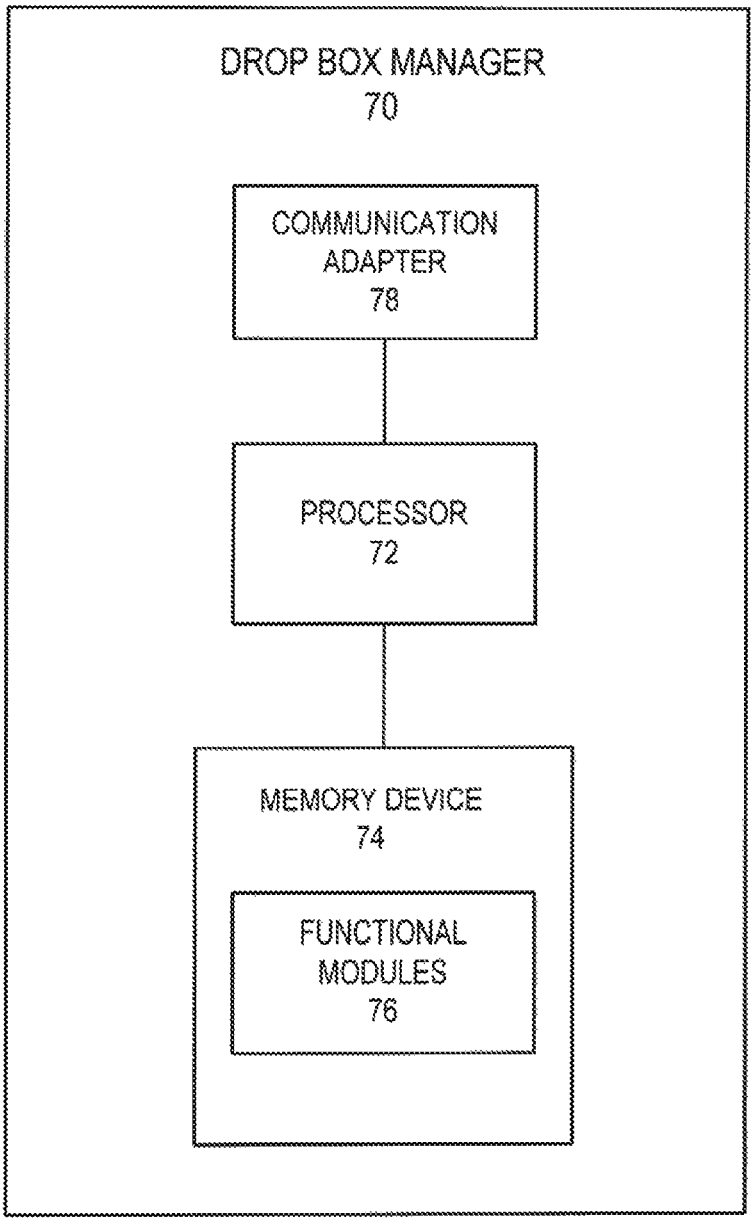
FIG. 6 is a schematic block diagram illustrating an electronic configuration for a drop box manager according to some embodiments.

FIG. 6 is a block diagram that illustrates various components of a drop box manager 70 according to some embodiments. As shown in FIG. 6, the drop box manager 70 may include a processor 72 that controls operations of the drop box manager. Although illustrated as a single processor, multiple special purpose and/or general purpose processors and/or processor cores may be provided in the drop box manager 70. For example, the EGM 100 may include one or more of a video processor, a signal processor, a sound processor and/or a communication controller that performs one or more control functions within the EGM 100. The processor 72 may be variously referred to as a "controller," "microcontroller," "microprocessor" or simply a "computer." The processor may further include one or more application-specific integrated circuits (ASICs).

Various components of the drop box manager 70 are illustrated in FIG. 6 as being connected to the processor 72. It will be appreciated that the components may be connected to the processor 72 through a system bus, a communication bus and controller, such as a USB controller and USB bus, a network interface, or any other suitable type of connection.

The drop box manager 70 further includes a memory device 74 that stores one or more functional modules 76 for performing the operations described above.

The memory device 74 may store program code and instructions, executable by the processor 72, to control the drop box manager 70. The memory device 74 may include random access memory (RAM), which can include nonvolatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The drop box manager 70 may include a communication adapter 78 that enables the drop box manager 70 to communicate with remote devices, such as EGMs 100 and/or a player tracking server 45 (FIG. 1) over a wired and/or wireless communication network, such as a local area network (LAN), wide area network (WAN), cellular communication network, or other data communication network.

The EGM 100 may include one or more internal or external communication ports that enable the processor 72 to communicate with and to operate with internal or external peripheral devices, such as display screens, keypads, mass storage devices, microphones, speakers, and wireless communication devices. In some embodiments, internal or external peripheral devices may communicate with the processor through a universal serial bus (USB) hub (not shown) connected to the processor 72.

Although illustrated and discussed as a separate device, some embodiments provide that the drop box manager 70 and some or all of the components therein may be implemented in the central controller 40 (FIG. 1).

In various embodiments, the gaming system includes one or more player tracking systems under control of the player tracking module 20B shown in FIG. 5C. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

As noted above, a player's progress or status can be saved in other ways besides using a player tracking system, such as by generating, when the player cashes out, a ticket including a printed code, such as a bar code or QR code, that identifies the player's session. When the player wants to continue the game, the player may insert the ticket including the printed code into the bill/ticket acceptor 128 of an EGM 100 (which may or may not be the same EGM 100 from which the ticket was issued). The EGM 100 reads the printed code and retrieves the player's status in response to the printed code.

Embodiments described herein may be implemented in various configurations for EGMs 100*s*, including but not limited to: (1) a dedicated EGM, wherein the computerized instructions for controlling any games (which are provided by the EGM) are provided with the EGM prior to delivery to a gaming establishment; and (2) a changeable EGM, where the computerized instructions for controlling any games (which are provided by the EGM) are downloadable to the EGM through a data network when the EGM is in a gaming establishment. In some embodiments, the computerized instructions for controlling any games are executed by at least one central server, central controller or remote host. In such a "thin client" embodiment, the central server remotely controls any games (or other suitable interfaces) and the EGM is utilized to display such games (or suitable interfaces) and receive one or more inputs or commands from a player. In another embodiment, the computerized instructions for controlling any games are communicated from the central server, central controller or remote host to a EGM local processor and memory devices. In such a "thick client" embodiment, the EGM local processor executes the communicated computerized instructions to control any games (or other suitable interfaces) provided to a player.

In some embodiments, an EGM may be operated by a mobile device, such as a mobile telephone, tablet other mobile computing device.

In some embodiments, one or more EGMs in a gaming system may be thin client EGMs and one or more EGMs in the gaming system may be thick client EGMs. In another embodiment, certain functions of the EGM are implemented in a thin client environment and certain other functions of the EGM are implemented in a thick client environment. In one such embodiment, computerized instructions for controlling any primary games are communicated from the central server to the EGM in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal EGMs, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In some embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/" Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of the present inventive concept and is not to be construed as limited to the embodiments disclosed herein, and that modifications to the disclosed embodiments, as well as other embodiments, are intended to be included within the scope of the appended claims. The present inventive concept is defined by the following claims.

What is claimed is:

1. A method, comprising:

receiving, from an electronic gaming machine (EGM) via a communication network, drop box initiator data that corresponds to a drop box initiator ticket in response to the drop box initiator ticket being input into a drop box installed in the EGM;

automatically identifying the drop box initiator ticket as a first transaction item in a drop box session that begins responsive to the drop box being installed in the EGM and that ends corresponding to the drop box being removed from the EGM;

receiving, from the EGM during the drop box session via the communication network, drop box session transaction data that occurs after the drop box initiator ticket is received by the EGM during the drop box session; and automatically associating the drop box with the EGM for a time period corresponding to the drop box session.

2. The method according to claim 1, further comprising generating a drop box session report that includes the drop box session transaction data corresponding to currency and/or transaction receipts that are stored in a stacker of the drop box.

3. The method according to claim 2, wherein the transaction receipts comprise data tickets that are received to convey monetary value from a player to the EGM.

4. The method according to claim 2, wherein generating the drop box session report comprises:

retrieving the drop box initiator ticket from the drop box after the drop box is removed from the EGM; and associating the drop box, the EGM and the drop box session transaction data.

5. The method according to claim 2, wherein the drop box initiator ticket is visually distinctive from the transaction receipts.

6. The method according to claim 5, wherein the drop box initiator ticket includes a first color and the transaction receipts include a second color that is different from the first color.

7. The method according to claim 1, wherein automatically identifying the drop box initiator ticket as a first transaction item in the drop box session comprises detecting a unique identifier on the drop box initiator ticket.

8. The method according to claim 7, wherein the drop box initiator ticket comprises a nominal transaction amount.

9. The method according to claim 1, the method further comprising providing the drop box initiator ticket that includes a unique identifier and that is configured to be received by the EGM upon installation of the drop box therein.

10. The method according to claim 1, wherein receiving drop box session transaction data comprise receiving, from the EGM during the drop box session via the communication network, drop box session transaction data in response to currency and/or transaction receipts being input into the drop box, the method further comprising:

receiving, from the EGM via the communication network, a drop signal that indicates a completion of the drop box session; and responsive to receiving the drop signal, associating the drop box session transaction data that was received after the drop box initiator ticket was received by the EGM with the drop box, the drop box session, and the EGM.

11. The method according to claim 10, wherein the drop box comprises a first drop box;

wherein the drop box initiator ticket comprises a first drop box initiator ticket, wherein the drop box initiator data comprises first drop box initiator data, wherein the drop box session comprises a first drop box session that is initiated corresponding to the first drop box initiator ticket and corresponds to the first drop box, and wherein receiving the drop signal comprises receiving, from the EGM via the communication network, second drop initiator data that corresponds to a second drop box initiator ticket that is received by the EGM and that corresponds to a second drop box that is installed in the EGM after the first drop box is removed.

12. A system, comprising:

a server that includes a processing device and a memory, the memory configured to store computer readable instructions that, when executed, cause the processing device to:

receive, from an electronic gaming machine (EGM) via a communication network, drop box initiator data that corresponds to a drop box initiator ticket in response to the drop box initiator ticket being input into a drop box installed in the EGM;

automatically identify the drop box initiator ticket as a first transaction item in a drop box session that begins responsive to the drop box being installed in the EGM;

receive, from the EGM during the drop box session and via the communication network, drop box session transaction data that occurs after the drop box initiator ticket is received by the EGM during the drop box session;

automatically associate the drop box with the EGM for a time period corresponding to the drop box session; and generate a drop box session report that includes the drop box session transaction data corresponding to currency and/or transaction receipts that are stored in a stacker of the drop box.

13. The system according to claim 12, wherein the drop box session transaction data that is received from the EGM is provided without being associated with the drop box.

14. The system according to claim 12, wherein the instructions that cause the processing device to generate the drop box session report are further configured to cause the processing device to:

retrieve the drop box initiator ticket from the drop box after the drop box is removed from the EGM; and associate the drop box, the EGM and the drop box session transaction data.

15. The system according to claim 12, wherein the instructions that cause the processing device to automatically identify the drop box initiator ticket as a first transaction item in the drop box session are further configured to cause the processing device to detect a unique identifier on the drop box initiator ticket.

16. The system according to claim 15, wherein the drop box initiator ticket comprises a nominal transaction amount.

17. The system according to claim 12, further comprise instructions that cause the processing device to:

receive, from the EGM via the communication network, a drop signal that indicates a completion of the drop session; and responsive to receiving the drop signal, to associate the drop box session transaction data that was received after the drop box initiator ticket was received by the EGM.

18. A method, comprising:

receiving, by an electronic gaming machine (EGM), a drop box that is configured to store currency and/or transaction receipts that are received by the EGM during a drop box session and that includes a stacker that is operable to store received currency and/or transaction receipts;

receiving, by the EGM, a drop box initiator ticket that includes a unique identifier that signals a beginning of the drop box session; and responsive to receiving the drop box initiator ticket, transmitting, by the EGM to a server via a communication network, drop box initiator data that corresponds to the drop box initiator ticket that was received by the EGM.

19. The method according to claim 18, the method further comprising transmitting, by the EGM via the communication network, a drop signal that indicates a completion of the drop box session.

20. The method according to claim 18, wherein the drop box comprises a first drop box, wherein the drop box session comprises a first drop box session, wherein transmitting the drop signal is performed corresponding to a removal of the first drop box and indicates an end of the first drop box session, the method further comprising:

receiving, by the EGM, a second drop box that is configured to store currency and/or transaction receipts that are received by the EGM during a second drop box session that is after the first drop box session;

receiving, by the EGM, a second drop box initiator ticket that includes another unique identifier that signals a beginning of the second drop box session; and transmitting, by the EGM to a server via the communication network, second drop box initiator data that corresponds to the second drop box initiator ticket that was received by the EGM.

* * * * *